US005113836A

United States Patent [19]

Sweeten

[11] Patent Number: 5,113,836

[45] Date of Patent: * May 19, 1992

[54] FILTER FOR LOWERING HARMFUL CRANKCASE EMISSIONS IN AN INTERNAL COMBUSTION ENGINE

[75] Inventor: Theodore P. Sweeten, Paulden, Ariz.

[73] Assignee: Ventures Unlimited, Inc., Paulden, Ariz.

[ * ] Notice: The portion of the term of this patent subsequent to Dec. 17, 2008 has been disclaimed.

[21] Appl. No.: 674,105

[22] Filed: Mar. 25, 1991

Related U.S. Application Data

[63] Continuation-in-part of Ser. No. 607,586, Nov. 1, 1990, Pat. No. 5,072,713, which is a continuation-in-part of Ser. No. 542,721, Jun. 25, 1990, abandoned.

[51] Int. Cl.[5] ..... F02M 25/00

[52] U.S. Cl. ..... 123/573; 123/574; 123/41.86

[58] Field of Search ..... 123/572, 573, 574, 41.86

[56] References Cited

U.S. PATENT DOCUMENTS

| | | | |
|---|---|---|---|
| Re. 30,682 | 7/1981 | Bush | 123/573 |
| 3,877,451 | 4/1975 | Lipscomb | 123/573 |
| 4,167,164 | 9/1979 | Bachmann | 123/573 |
| 4,502,424 | 3/1985 | Katoh et al. | 123/573 |
| 4,886,033 | 12/1989 | Betterton et al. | 123/574 |

*Primary Examiner*—E. Rollins Cross
*Assistant Examiner*—M. Macy
*Attorney, Agent, or Firm*—Jordan M. Meschkow; Flickinger Don J.; Lowell W. Gresham

[57] ABSTRACT

Apparatus for receiving crankcase emissions from an internal combustion engine and for separating the liquid portions of the emissions from the gaseous portion thereof. The apparatus includes a mounting flange, an opening for the return of the liquids to the engine, and at least one layer of filtering material. In one embodiment, the filtering material may be soaked with oil. Another embodiment has a screw mounted in the housing, and positioned to retard the flow of emissions exiting from the housing. The apparatus includes an outlet for return of the gaseous portion of the emissions to return to the combustion chamber via the PCV line or the induction manifold.

12 Claims, 2 Drawing Sheets

FIG. 6
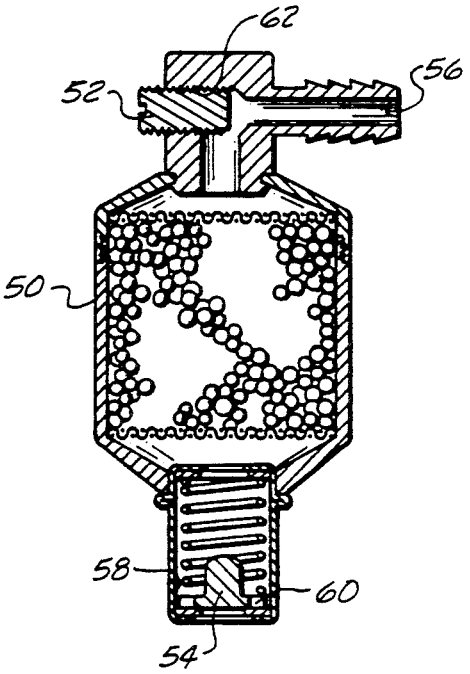
FIG. 5
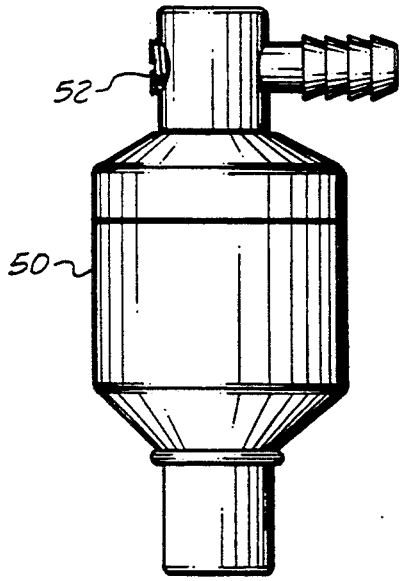
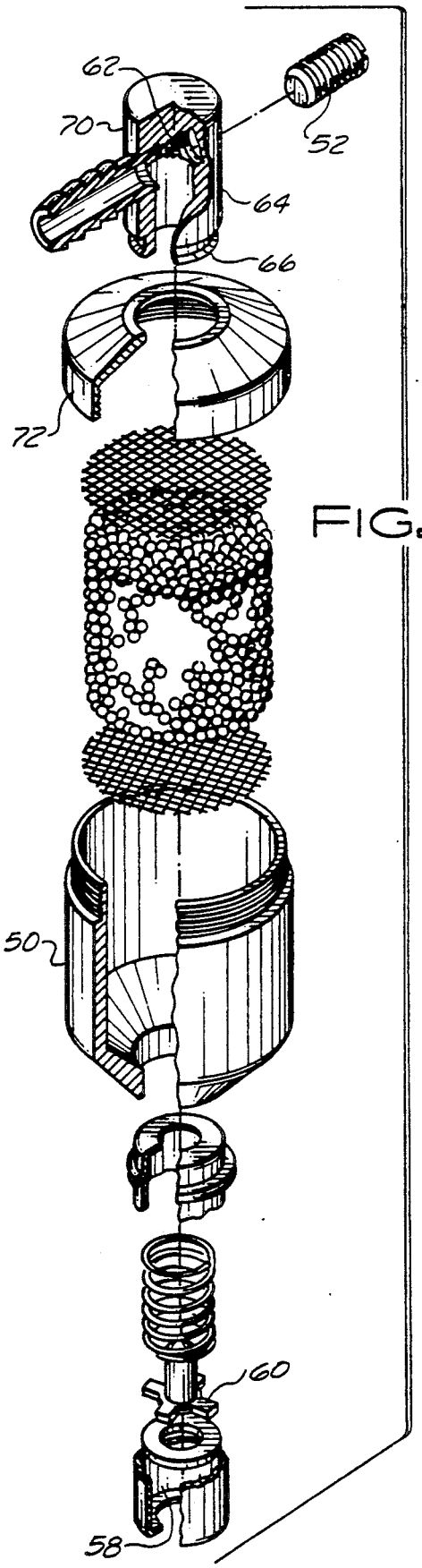
FIG. 7

FILTER FOR LOWERING HARMFUL CRANKCASE EMISSIONS IN AN INTERNAL COMBUSTION ENGINE

This application is a continuation-in-part of my pending application, filed Nov. 1, 1990 and assigned Ser. No. 07/607,586, now U.S. Pat. No. 5,072,713 which is a continuation-in-part of my co-pending application, filed Jun. 25, 1990. and assigned Ser. No. 07/542,721, now abandoned.

FIELD OF THE INVENTION

This invention relates to the field of air pollution control of harmful crankcase emissions from the internal combustion engine, and more particularly to a filtering device for reducing these emissions.

BACKGROUND OF THE INVENTION

The internal combustion engine contains harmful pollutants in its crankcase. These pollutants are caused by blow-by gases from the combustion chamber and the rotating action of the crankshaft turning in the crankcase. In the past these harmful emissions were vented into the air via a road draft tube, or through a PCV valve into the combustion chamber of the engine.

A number of inventions have tried to reduce harmful crankcase emissions with varying degrees of success. For previous inventions in this field, see patents U.S. Pat. Nos. 3,450,114; 3,463,132; 3,779,221; 4,089,309; 4,167,164; and 4,370,971. These inventions have in common either a vent to atmospheric air, a container for collecting harmful emissions, or a combination of both in many cases.

The prior art generally uses one or both of these parts to filter or separate harmful crankcase emissions. Use of such components is problematic for at least two reasons.

Atmospheric venting allows the drawing in of air into the combustion chamber. This adversely affects computerized automobiles. The computerized vehicle is designed to allow air only into the combustion chamber via the intake manifold. The California Air Resources Board does not allow the use of the air vent shown in U.S. Pat. No. 4,370,971 on cars equipped with either three way catalyst or oxidation catalyst. See California Air Resources Board Executive Order #D-69-4. The sale of this product in California is only allowed when the atmospheric vent is plugged.

It is also not desirous to have a collection chamber that stores separated solid and liquid portions of the crankcase emissions from the crankcase because a toxic waste is created. Furthermore this toxic waste must then be disposed of, creating unnecessary and burdensome problems for the consumer.

The present invention is designed to reduce emissions without a collection chamber, so there is no collection of toxic waste. It accomplishes this by means of a unique filtration system that separates the filter material by air spaces and allows the heavy hydrocarbons to flow back into the combustion chamber. The present invention is an improvement over previous inventions because it accomplishes more complete filtration of heavier unburnable hydrocarbons without the use of an air vent to the atmosphere or a collection canister to store the liquid portion of the crankcase emissions.

SUMMARY OF THE INVENTION

It is an object of this invention to provide a pollution control device for reducing harmful crankcase emissions from the internal combustion engine.

It is additionally an object of this invention to provide a device that can be adapted to a variety of internal combustion engines.

It is a further object of this invention to provide a pollution control device that is easy to install, economical to use, and requires no maintenance for trouble free operation by means of a special filtering system not used before in an internal combustion engine for separating harmful crankcase emissions.

An additional object of this invention is to eliminate the creation of a toxic waste created by other devices using a collection chamber to store separated blow-by gases.

It is also an object of this invention to provide a filter - separator that has no atmospheric air vent to aid in the separation of the blow-by gases.

It is further an object of this invention to provide a filter with selectively controllable flow metering.

Another object of this invention to provide a filter that individually can be used with different size engines, because it has selectively controllable flow metering.

Other objects, together with the foregoing are contained in the embodiment described in the following description and illustrated in the accompanying drawings.

BRIEF DESCRIPTION OF DRAWINGS

FIG. 5 is a side view of yet another alternate embodiment of the invention.

FIG. 6 is a cutaway view of the alternate embodiment of the invention in FIG. 5.

FIG. 7 is an exploded view of the alternate embodiment of the invention in FIG. 6.

DETAILED DESCRIPTION OF THE PREFERRED EMBODIMENT

While the crankcase filter of this invention is susceptible of numerous physical embodiments, depending on the requirements of use, substantial numbers of the herein shown and described embodiment have been made and tested and all have performed with excellent results in reducing harmful emissions.

Figure 1:
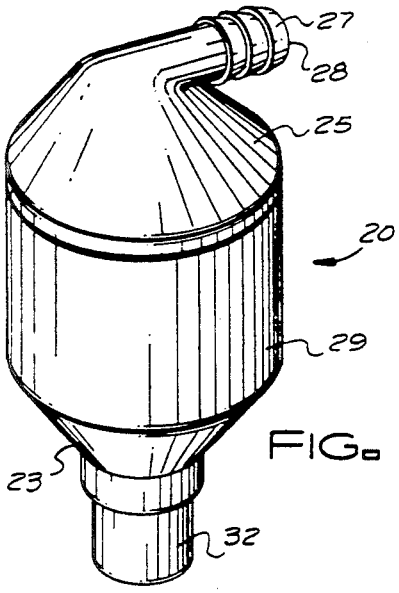
FIG. 1 is a perspective view of an alternate embodiment of the invention.
Figure 2:
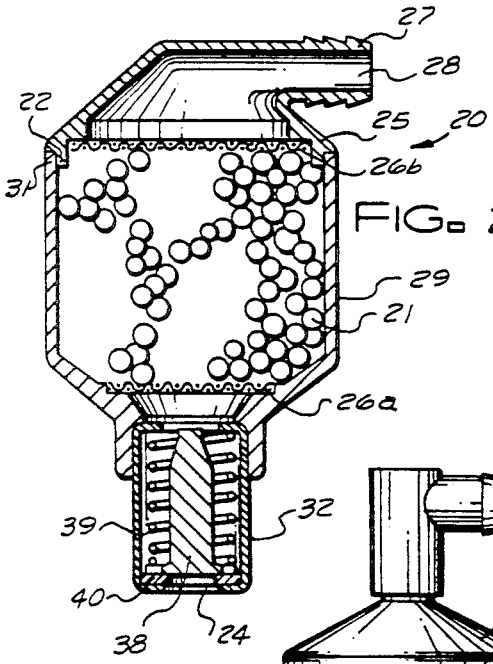
FIG. 2 is a cutaway view of the alternate embodiment of the invention in FIG. 1, taken vertically through the center of the alternate embodiment of the invention shown in FIG. 1.

An embodiment of the present invention is shown in FIG. 1, characterized by reference number 20. A cutaway view of filter 20 is shown in FIG. 2, and will be integrally referred to herein. Crankcase filter 20 shown in FIG. 1 is utilized in conjunction with an internal combustion engine (not shown).

Two housings, upper housing 25 and lower housing 29 hold the contents of the invention. In the embodiment shown, housing 25 and housing 29 are press-fit together with upper housing flange 22 and lower housing flange 31. This press-fit connection may be furthered strengthened by using glue, or welding or melting.

Inlet housing 32 is coupled to the engine crankcase either directly or with a hose, and allows the entrance of harmful crankcase emissions into the filter through aperture 24. Outlet 27 has aperture 28 which allows filtered gases to pass on to the combustion chamber via the PCV line in an automobile or the induction manifold on a diesel engine. As shown, outlet 27 also has ridges to firmly hold the PCV line or the induction manifold.

Inlet 32 is designed to fit the crankcase outlet of an internal combustion engine. The housing of inlet 32 press-fits into housing 29.

Like before, beveled surface 23 is placed just above inlet 32 to allow the flow of heavier hydrocarbons back into the crankcase. Screen 26*a* is placed at the top end of beveled surface 23 to hold an assortment of adsorbent silica bead particles 21 used to filter out heavy hydrocarbons. Silica bead particles 21 are typically Silica Dioxide. The performance of silica bead particles 21 has been found to have been greatly enhanced by soaking them in an oil enhancing product, such as STP, Morey's Stabilizer or Energy Release. Alternately, the filtering material may be silica gel, carbon particles, or a combination of both.

Screen 26*b* is placed on top of silica bead particles 21 to hold them in place. Screens 26*a* and 26*b* may be made of either plastic or stainless steel or a combination of both depending on production requirements.

As shown in FIG. 2, a standard PCV valve common to today's gasoline engines may also be incorporated into this filter to further simplify installation of the unit. Inlet 32 houses spring 39 and valve 38, which acts as a PCV valve. Washer 40 is used for maintaining the closed position of valve 38. Those skilled in the art will understand that for vehicles with a PCV valve, or for vehicles that do not require a PCV valve, washer 40, spring 39, and valve 38 may be omitted.

Figure 3:
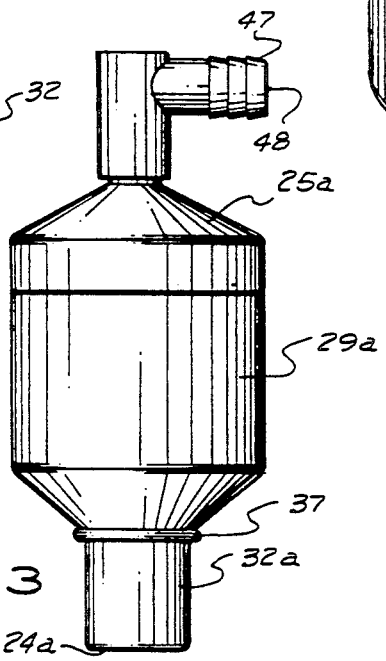
FIG. 3 is a side view of yet another alternate embodiment of the invention.
Figure 4:
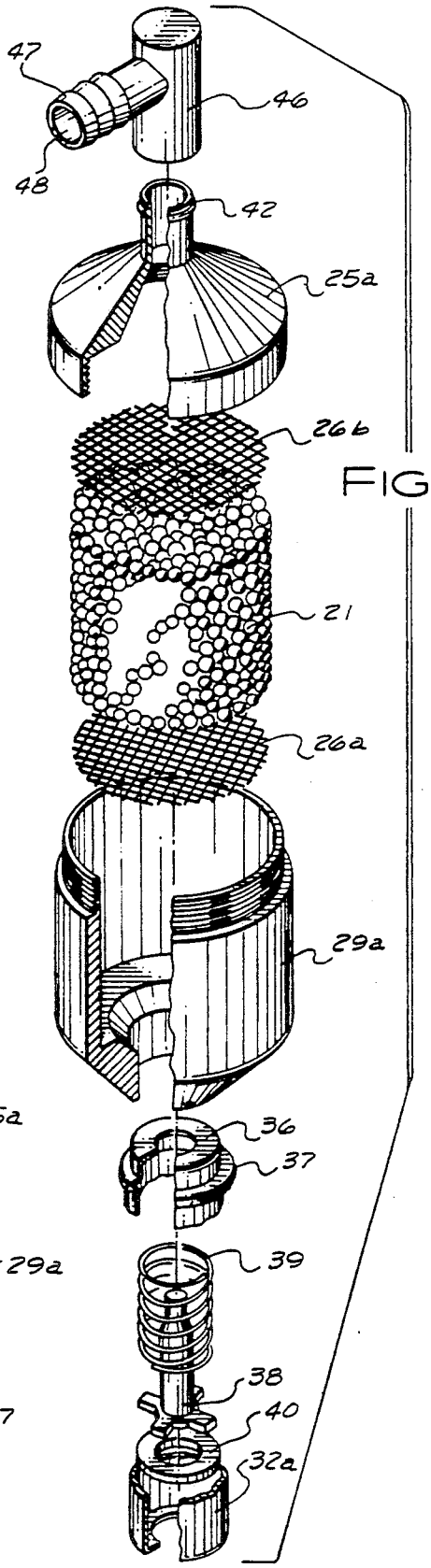
FIG. 4 is an exploded view of the alternate embodiment of the invention in FIG. 3.

FIGS. 3 and 4 show still another alternate embodiment. This alternate embodiment closely resembles the last one, but this one has a metal housing.

Due to its metal housing, housings 25*a* and 29*a* are screw-fitted. Further, outlet 47 with aperture 48 is coupled to outlet adapter 46. Outlet adapter 46 couples to housings 25*a* by way of coupler 42.

Another significant feature, which could be incorporated into the former embodiments, is shoulder 37 of inlet housing 32*a*. Shoulder 37 allows inlet housing 32*a* to be inserted at a predetermined depth, thereby regulating current flow.

Turning to FIG. 5, another alternate embodiment of the invention, is shown. Similar to the embodiments shown in FIGS. 1 and 3, this embodiment contains air metering screw 52.

FIG. 6 is a cutaway view of the embodiment shown in FIG. 5, and more clearly illustrates air metering screw 52 and another changed feature, valve 54. By turning air metering screw 52 clockwise against threads 62 in the housing, it would move inward thereby variably restricting the flow through outlet 56. Turning air metering screw 52 counterclockwise against threads 62 in the housing would move air metering screw 52 outward, thereby variably increasing the flow through outlet 56 up to a nominal rate. This ability to increase or decrease the flow, within a range, provides the utility of allowing filter 50 to be adjusted for use with different size engines.

Valve 54 is analogous to PCV valve 38 in FIG. 4, but has been shortened. As such valve 54 does not regulate flow, like valve 38, but still provides the function of cleaning filtered residue from surface 58, with a gentle scraping effect from tabs 60.

FIG. 7 provides an exploded view of embodiment 50. Outlet assembly 70 has shell 64 with collar 66. Collar 66 press fits into filter shell top 72. It should be obvious to those skilled in the art that other than those differences described herein, filter 50 is analogous in other respects to the embodiment shown in FIGS. 3 and 4.

OPERATION OF INVENTION

In the embodiment shown in FIGS. 1–4, crankcase emissions by vacuum are pulled into inlet 32, past PCV valve 38, where they contact oil additive coated silica bead particles 21. The coating bridges the gaps in the silica beads. Alternately filtering material 21 could be silica gel, carbon particles, or a combination of both.

This coating forms a mucous-like membrane barrier between the gaps in the filtering material 21. This membrane stops the passage of liquid and solids into the combustion chamber. Only clean, combustible gases are allowed to pass through this filter. The liquid portions of the crankcase emissions drain back into the crankcase every time the engine is shut off thus eliminating the need for a canister to collect the liquids.

The alternate embodiment shown in FIGS. 5–7 incorporates air metering screw 52. The operation of this embodiment is analogous to the other. The PCV valve may be omitted, because the flow is controllable with air metering screw 52.

Various changes and modifications to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant inventing and alternately preferred embodiments thereof in such clear and concise terms as to enable those skilled in the art to understand and practice the same, the invention claimed is:

1. In combination with a crankcase vent connected to an internal combustion engine, a device for separating emissions, said device comprising:

a housing;

an inlet for taking in crankcase emissions;

filtering material; and manually adjustable metering means for selectively controlling the discharge of said emissions from said housing.

2. The apparatus of claim 1 wherein said filtering material is coated with oil.

3. The apparatus of claim 1 wherein said filtering material is coated with an oil enhancing product.

4. The apparatus of claim 3 wherein said oil enhancing product is STP.

5. The apparatus of claim 3 wherein said oil enhancing product is Energy Release.

6. The apparatus of claim 3 wherein said oil enhancing product is Morey's Stabilizer.

7. The apparatus of claim 1 wherein said filtering material is a mixture of silica gel and carbon particles.

8. The apparatus of claim 1 wherein said filtering material is silica gel.

9. The apparatus of claim 1 wherein said filtering material is carbon particles.

10. The apparatus of claim 1 wherein said filtering material is silica beads.

11. The apparatus of claim 1 wherein said metering means comprises a member screwed into the housing, and positioned to retard the flow of emissions exiting from said housing.

12. In a filter for separating crankcase vent emissions from an internal combustion engine, said device comprising:

a housing;

an inlet for taking in crankcase emissions; and filtering material;

The improvement comprising:

manually adjustable metering means for selectively controlling the discharge of said emissions from said housing.

* * * * *